US008356666B2

(12) United States Patent
Walker et al.

(10) Patent No.: US 8,356,666 B2
(45) Date of Patent: Jan. 22, 2013

(54) WELLBORE PERFORATION TOOL

(75) Inventors: Jerry L. Walker, Azle, TX (US); John H. Hales, Frisco, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 160 days.

(21) Appl. No.: 12/690,098

(22) Filed: Jan. 19, 2010

(65) Prior Publication Data

US 2011/0174486 A1 Jul. 21, 2011

(51) Int. Cl.
*E21B 43/11* (2006.01)

(52) U.S. Cl. ..... 166/297; 166/277; 166/55; 166/55.2

(58) Field of Classification Search ..... 166/277, 166/377, 297, 55, 55.2, 319
See application file for complete search history.

(56) References Cited

U.S. PATENT DOCUMENTS

| | | | | |
|---|---|---|---|---|
| 3,305,032 | A | 2/1967 | Schuster et al. | |
| 4,756,371 | A * | 7/1988 | Brieger | 166/312 |
| 7,393,423 | B2 | 7/2008 | Liu | |
| 7,430,965 | B2 * | 10/2008 | Walker | 102/310 |
| 7,441,601 | B2 | 10/2008 | George et al. | |
| 7,607,379 | B2 | 10/2009 | Rospek et al. | |
| 7,621,342 | B2 * | 11/2009 | Walker | 175/4.55 |
| 2006/0075889 | A1 | 4/2006 | Walker | |
| 2007/0107589 | A1 * | 5/2007 | Rospek et al. | 89/1.15 |
| 2008/0230225 | A1 * | 9/2008 | Meddes et al. | 166/297 |
| 2008/0289812 | A1 * | 11/2008 | El-Khazindar et al. | 166/101 |
| 2011/0221137 | A1 * | 9/2011 | Obi et al. | 277/316 |
| 2012/0198988 | A1 * | 8/2012 | Volberg et al. | 89/1.15 |

FOREIGN PATENT DOCUMENTS

| | | | |
|---|---|---|---|
| DE | 102005059934 | A1 | 8/2006 |
| WO | 2005033472 | A1 | 4/2005 |
| WO | 2011045021 | A2 | 4/2011 |

OTHER PUBLICATIONS

European Search Report, Oct. 20, 2011, Application No. EP 11151325, European Patent Office.

* cited by examiner

*Primary Examiner* — Jennifer H Gay
*Assistant Examiner* — Elizabeth Gitlin

(57) ABSTRACT

A wellbore perforation tool comprises an explosive charge, a tool body containing the explosive charge, and a flowable material carried with the tool. The flowable material is released by detonation of the explosive charge and, after perforation of the tool body by the explosive charge to form an aperture in the tool body, flows to form at least a partial barrier of the aperture.

12 Claims, 6 Drawing Sheets

WELLBORE PERFORATION TOOL

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun. A packer may be set and a formation proximate to the wellbore may be hydraulically fractured. A plug may be set in the wellbore. Typically it is undesirable for debris, fines, and other material to accumulate in the wellbore. Fines may comprise more or less granular particles that originate from the subterranean formations drilled through or perforated. The debris may comprise material broken off of drill bits, material cut off casing walls, pieces of perforating guns, and other materials. A wellbore may be cleaned out or swept to remove fines and/or debris that have entered the wellbore. Those skilled in the art may readily identify additional wellbore servicing operations. In many servicing operations, a downhole tool is conveyed into the wellbore and then is activated by a triggering event to accomplish the needed wellbore servicing operation.

SUMMARY

In an embodiment, a perforation tool is provided. The tool comprises an explosive charge, a tool body containing the explosive charge, and a flowable material carried with the tool. The flowable material is released by detonation of the explosive charge and, after perforation of the tool body by the explosive charge to form an aperture in the tool body, flows to create at least a partial barrier to flow through the aperture.

In an embodiment, a method of perforating a wellbore is provided. The method comprises running a perforation tool into the wellbore and the perforation tool perforating the wellbore. The method further comprises significantly closing an aperture in the perforation tool only after at least 10 seconds after perforating the wellbore.

In an embodiment, a perforation tool is provided. The tool comprises an explosive charge, a tool body containing the shaped explosive charge, and a swellable material carried with the tool body.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
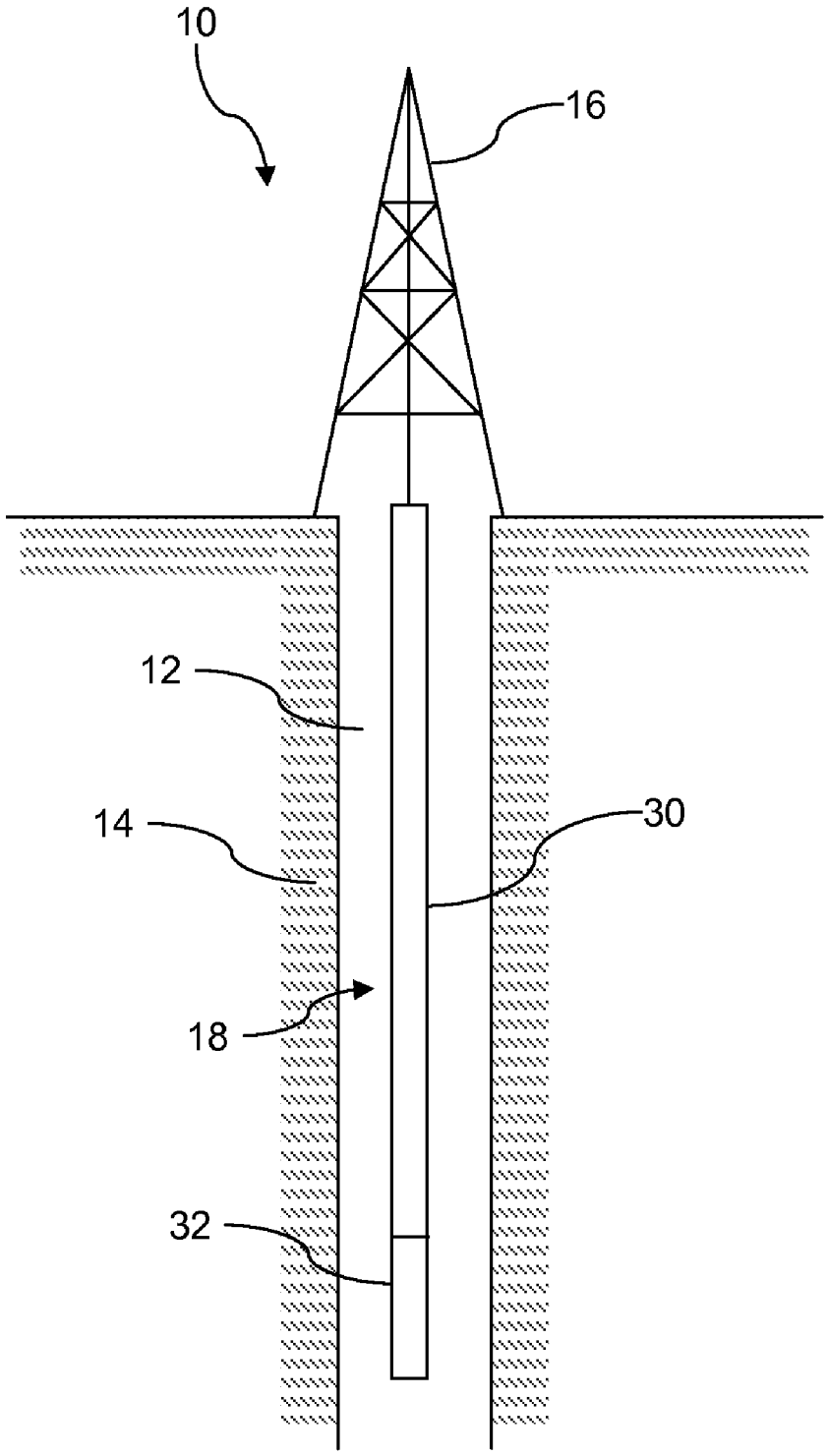
FIG. 1 illustrates a wellbore, a conveyance, and a toolstring according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to.". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Withdrawing fired perforation guns built according to some previously known designs from wellbores or lateral wellbores, for example deviated and/or horizontal portions of wellbores, may shake and rotate the perforation guns and cause debris to escape from the interior of the perforation gun through holes in the perforation gun, opened by firing, to be littered in the wellbore. The present disclosure teaches a perforation gun that reduces leavings of debris by the perforation gun. In an embodiment, a shaped charge in the perforation gun fires, penetrates an optional wellbore casing, and penetrates into a formation. After the firing of the shaped charge, a deformable or flowable material carried with the perforation gun moves to obstruct, at least partially, a hole created in a tool body of the perforation gun. In some contexts, this may be referred to as forming an at least partial barrier to egress of debris from an interior of the perforation gun and/or tool body of the perforation gun through apertures created in the perforation tool by detonation of the shaped charge and/or charges. This may also be referred to as forming an at least partial barrier to flow through the aperture. When the perforation gun is thereafter withdrawn from the wellbore, the at least partial obstruction and/or at least partial barrier of the hole in the tool body by the deformable or flowable material reduces or stops propagation of debris from the interior of the tool body out of the hole in the tool body into the wellbore. With the increased prevalence of deviated and horizontal wellbores and lateral wellbores, systems for attenuating the littering of debris from perforation guns may become increasingly important. A variety of different deformable and/or flowable materials that may be suitable for use in the perforation gun are discussed in more detail herein after.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure that supports a workstring 18 in the wellbore 12. In other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a perforation tool 32, and other tools and/or subassemblies (not shown) located above or below the perforation tool 32. The conveyance 30 may comprise any of a string of jointed pipes, a slickline, a coiled tubing, a wireline, and other conveyances for the perforation tool 32. In an embodiment, the perforation tool 32 comprises one or more explosive charges that may be triggered to explode, perforating a wall of the wellbore 12 and forming perforations or tunnels out into the formation 14. The perforating may promote recovering hydrocarbons from the formation 14 for production at the surface, storing hydrocarbons flowed into the formation 14, or disposing of carbon dioxide in the formation 14, or the like. The perforation may provide a pathway for gas injection.

Figure 2:
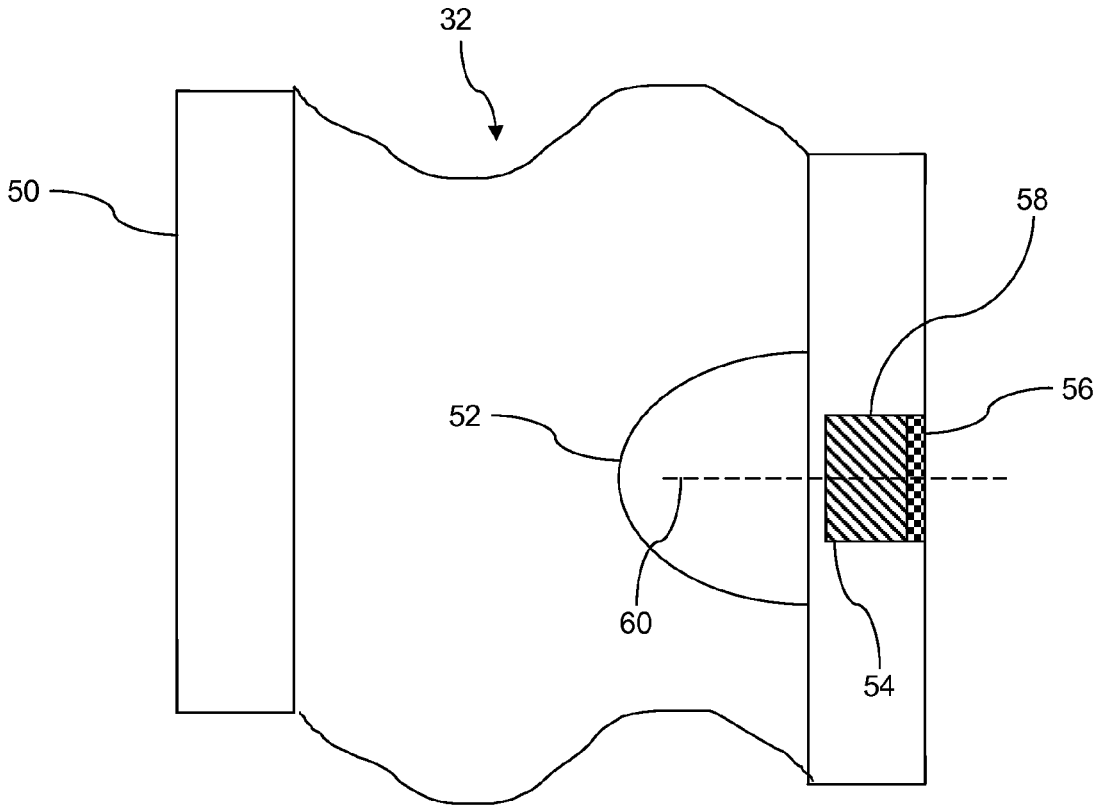
FIG. 2 illustrates an explosive charge, a portion of a perforation tool body, and a flowable material according to an embodiment of the disclosure.

Turning now to FIG. 2, a first embodiment of the perforation tool 32 is described. This embodiment comprises a tool body 50 enclosing an explosive charge 52, a flowable material 54, and optionally a cap 56. When the explosive charge 52 is detonated, the explosive charge 52 pierces the tool body 50, pierces the flowable material 54, and perforates the wellbore 12. Sometime after the perforation of the wellbore 12 and before withdrawal of the workstring 18 from the wellbore 12, the flowable material 54 flows to at least partially block and/or to create at least a partial barrier of an aperture or hole formed in the tool body 50 by detonation of the explosive charge 52. This may also be referred to as forming an at least partial barrier to flow through the aperture. As the perforation tool 32 is withdrawn from the wellbore 12, the flowable material 54 attenuates or prevents littering of debris from the interior of the perforation tool 32 through the aperture and/or apertures in the tool body 50 into the wellbore 12.

As used herein the term 'flowable' refers to the ability of an object to undergo progressive motion, i.e., to flow, wherein different volumes of the object move at different speeds. As used herein, the term 'flowable' expressly includes the idea of swelling and/or expanding. A flowable material may flow responsive to forces that impinge upon it or responsive to internal forces, for example responsive to a swelling force resulting from absorbing material from the surrounding environment.

The tool body 50 may be a substantially tubular subassembly suitable for coupling to the conveyance 30 at one end. The tool body 50 may be constructed out of various metal materials as are known to those skilled in the art. The tool body 50 may be constructed of one or more kinds of steel including stainless steel, chromium steel, and other steels. Alternatively, the tool body 50 may be constructed of other non-steel metals or metal alloys. While a single explosive charge 52 is depicted in FIG. 2, in an embodiment, the perforation tool 32 may comprise a plurality of explosive charges 52 at least some of which are associated with a quantity of the flowable material 54 and optionally associated with the cap 56. It is understood that the description herebelow about the single explosive charge 52 in relation to the flowable material 54 and the optional cap 56 applies equally to a plurality of explosive charges 52.

In an embodiment, a plurality of explosive charges 52 may be disposed in a first plane perpendicular to the axis of the tool body 50, and additional planes or rows of additional explosive charges 52 may be positioned above and below the first plane. In an embodiment, three explosive charges 52 may be located in the same plane perpendicular to the axis of the tool body 50, 120 degrees apart. In other embodiments, however, more explosive charges 52 may be located in the same plane perpendicular to the axis of the tool body 50. In an embodiment, the direction of the explosive charges 52 may be offset by about 60 degrees between the first plane and a second plane, to promote more densely arranging the explosive charges 52 within the tool body 50. Thus, if there are three explosive charges 52 associated with the perforation tool 32, there may be three flowable material 54 components and optionally three caps 56—one flowable material 54 component and optionally one cap 56 for each explosive charge 52. Likewise with twelve explosive charges 52, there may be twelve flowable material 54 components and optionally twelve caps 56. Alternatively, some of the explosive charges 52 may not be associated with a flowable material 54. For example, in an embodiment, half of the explosive charges 52 may be associated with a flowable material 54 component and optionally a cap 56 while the remaining half of the explosive charges 52 are not associated with a flowable material 54 component or a cap 56. Alternatively, some other faction of the explosive charges 52 may be associated with the flowable material component 54 and optional cap 56 while its complementary fraction of explosive charges is not associated with the flowable material component 54 and optional cap 56. In an embodiment, the flowable material 54 may be disposed in a ring fully or partially encircling the outside or inside of the tool body 50 proximate to the explosive charges 52. The cap 56, likewise, may be disposed in a ring fully or partially encircling the outside of the tool body 50 to protect the flowable material 54 and/or to isolate the flowable material 54 from the environment around the perforation tool 32.

In an embodiment, a frame structure (not shown) that retains the explosive charges 52 in planes, oriented in a preferred direction, and with appropriate angular relationships between rows, is disposed within the tool body 50. In an embodiment, a detonator cord couples to each of the explosive charges 52 to detonate the explosive charges 52. When the perforation tool 32 comprises multiple planes and/or rows of explosive charges 52, the detonator chord may be disposed on the center axis of the tool body 50. The detonator chord may couple to a detonator apparatus that is triggered by an electrical signal or a mechanical impulse or by another trigger signal. When the detonator activates, a detonation propagates through the detonation chord to each of the explosive charges 52 to detonate each of the explosive charges 52 substantially at the same time.

In an embodiment, the explosive charge 52 may be a shaped charge that is designed to focus explosive energy in a preferred direction, for example an explosive focus axis 60. The explosive charge 52 may comprise a first metal liner surrounding the convex side of the shaped explosive material and a second metal liner surrounding the concave side of the shaped explosive material. The explosive charge 52 may take the general form of a solid of revolution defined by a half-ellipse, a portion of a parabola, a portion of a hyperbola, a half circle, or some other shape. The explosive charge 52 may take the general form of a solid of revolution defined by a polygon.

The flowable material 54 may be disposed in a countersunk hole 58 on the outer surface of the tool body 50 and optionally covered by the cap 56. The cap 56 may protect the flowable material 54 from contamination or cutting at the surface, during run-in, and when the perforation tool 32 is located in firing position. Additionally, when the flowable material 54 is a swellable material, as discussed in more detail hereinafter, the cap 56 may prevent premature activation of the flowable material 54 by contact with activating agents, such as water and/or hydrocarbons. The cap 56 may be a plastic material sealed in place with a sealant. The cap 56 may be flowed to cover the flowable material 54 and then cure. The cap 56 may be a metal screw cap that couples threadingly with threads in a shoulder of the countersunk hole 58 and that engages one or more seals as the cap 56 is threaded into the threads of the countersunk hole 58, for example O-rings. The flowable material 54 may comprise a variety of materials. In alternative embodiment, the flowable material 54 may be retained in a countersunk hole by a cap on a inside of the tool body 50.

In an embodiment, the flowable material 54 may be any of a variety of swellable materials that are activated and swell in the presence of water and/or hydrocarbons. For example, low acrylic-nitrile may be used which swells by as much as fifty percent when contacted by xylene. For example, simple ethylene propylene diene rubber (EDPM) compound may be used which swells when contacted by hydrocarbons. For example, a swellable polymer, such as cross-linked polyacrylamide may be used which swells when contacted by water. In each of the above examples, the swellable material swells by action of the flowable material 54 absorbing and/or taking up liquids. In an embodiment, the swellable material may be activated to swell by one or more of heat and/or pressure.

It is to be understood that although a variety of materials other than the swellable material of the present disclosure may undergo a minor and/or insignificant change in volume upon contact with a liquid or fluid, such minor changes in volume and such other materials are not referred to herein by discussions referencing swelling or expansion of the swellable material. Such minor and insignificant changes in volume are usually no more than about 5% of the original volume.

In an embodiment, the swellable material may comprise a solid or semi-solid material or particle which undergoes a reversible, or alternatively, an irreversible, volume change upon exposure to a swelling agent (a resilient, volume changing material). Nonlimiting examples of suitable such resilient, volume changing materials include natural rubber, elastomeric materials, styrofoam beads, polymeric beads, or combinations thereof. Natural rubber includes rubber and/or latex materials derived from a plant. Elastomeric materials include thermoplastic polymers that have expansion and contraction properties from heat variances. Other examples of suitable elastomeric materials include styrene-butadiene copolymers, neoprene, synthetic rubbers, vinyl plastisol thermoplastics, or combinations thereof. Examples of suitable synthetic rubbers include nitrile rubber, butyl rubber, polysulfide rubber, EPDM rubber, silicone rubber, polyurethane rubber, or combinations thereof. In some embodiments, the synthetic rubber may comprise rubber particles from processed rubber tires (e.g., car tires, truck tires, and the like). The rubber particles may be of any suitable size for use in a wellbore fluid. An example of a suitable elastomeric material is employed by Halliburton Energy Services, Inc. in Duncan, Okla. in the Easywell wellbore isolation system.

In an embodiment, the swelling agent may comprise an aqueous fluid, alternatively, a substantially aqueous fluid, as will be described herein in greater detail. In an embodiment, a substantially aqueous fluid comprises less than about 50% of a nonaqueous component, alternatively less than about 35%, 20%, 5%, 2% of a nonaqueous component. In an embodiment, the swelling agent may further comprise an inorganic monovalent salt, multivalent salt, or both. A non-limiting example of such a salt includes sodium chloride. The salt or salts in the swelling agent may be present in an amount ranging from greater than about 0% by weight to a saturated salt solution. That is, the water may be fresh water or salt water. In an embodiment, the swelling agent comprises seawater.

In an alternative embodiment, the swelling agent comprises a hydrocarbon. In an embodiment, the hydrocarbon may comprise a portion of one or more non-hydrocarbon components, for example less than about 50% of a non-hydrocarbon component, alternatively less than about 35%, 20%, 5%, 2% of a non-hydrocarbon component. Examples of such a hydrocarbon include crude-oil, diesel, natural gas, and combinations thereof. Other such suitable hydrocarbons will be known to one of skill in the art.

In an embodiment, the swellable material refers to a material that is capable of absorbing water and swelling, i.e., increases in size as it absorbs the water. In an embodiment, the swellable material forms a gel mass upon swelling that is effective for flowing and blocking the aperture in the tool body 50. In some embodiments, the gel mass has a relatively low permeability to fluids used to service a wellbore, such as a drilling fluid, a fracturing fluid, a sealant composition (e.g., cement), an acidizing fluid, an injectant, etc., thus creating a barrier to the flow of such fluids. A gel refers to a crosslinked polymer network swollen in a liquid. The crosslinker may be part of the polymer and thus may not leach out of the gel. Examples of suitable swelling agents include superabsorbers, absorbent fibers, wood pulp, silicates, coagulating agents, carboxymethyl cellulose, hydroxyethyl cellulose, synthetic polymers, or combinations thereof.

The swellable material may comprise superabsorbers. Superabsorbers are commonly used in absorbent products, such as horticulture products, wipe and spill control agents, wire and cable water-blocking agents, ice shipping packs, diapers, training pants, feminine care products, and a multitude of industrial uses. Superabsorbers are swellable, crosslinked polymers that, by forming a gel, have the ability to absorb and store many times their own weight of aqueous liquids. Superabsorbers retain the liquid that they absorb and typically do not release the absorbed liquid, even under pressure. Examples of superabsorbers include sodium acrylate-based polymers having three dimensional, network-like molecular structures. The polymer chains are formed by the reaction/joining of hundreds of thousands to millions of identical units of acrylic acid monomers, which have been substantially neutralized with sodium hydroxide (caustic soda). Crosslinking chemicals tie the chains together to form a three-dimensional network, which enable the superabsorbers to absorb water or water-based solutions into the spaces in the molecular network and thus form a gel that locks up the liquid. Additional examples of suitable superabsorbers include crosslinked polyacrylamide; crosslinked polyacrylate; crosslinked hydrolyzed polyacrylonitrile; salts of carboxyalkyl starch, for example, salts of carboxymethyl starch; salts of carboxyalkyl cellulose, for example, salts of carboxymethyl cellulose; salts of any crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy-2-hydroxy-1-propane-sulfonic acid, acrylamide, and acrylic acid monomers; or combinations thereof. In one embodiment, the superabsorber absorbs not only many times its weight of water but also increases in volume upon absorption of water many times the volume of the dry material.

In an embodiment, the superabsorber is a dehydrated, crystalline (e.g., solid) polymer. In other embodiments, the crystalline polymer is a crosslinked polymer. In an alternative embodiment, the superabsorber is a crosslinked polyacrylamide in the form of a hard crystal. A suitable crosslinked polyacrylamide is the DIAMOND SEAL polymer available from Baroid Drilling Fluids, Inc., of Halliburton Energy Services, Inc. The DIAMOND SEAL polymer used to identify several available superabsorbents are available in grind sizes of 0.1 mm, 0.25 mm, 1 mm, 2 mm, 4 mm, and 14 mm. The DIAMOND SEAL polymer possesses certain qualities that make it a suitable superabsorber. For example, the DIAMOND SEAL polymer is water-insoluble and is resistant to deterioration by carbon dioxide, bacteria, and subterranean minerals. Further, the DIAMOND SEAL polymer can withstand temperatures up to at least 250° F. without experiencing breakdown and thus may be used in the majority of locations where oil reservoirs are found. An example of a biodegradable starch backbone grafted with acrylonitrile and acrylate is commercially available from Grain Processing Corporation of Muscantine, Iowa as WATER LOCK.

As mentioned previously, the superabsorber absorbs water and is thus physically attracted to water molecules. In the case where the swellable material is a crystalline crosslinked polymer, the polymer chain solvates and surrounds the water molecules during water absorption. In effect, the polymer undergoes a change from that of a dehydrated crystal to that of a hydrated gel as it absorbs water. Once fully hydrated, the gel usually exhibits a high resistance to the migration of water due to its polymer chain entanglement and its relatively high viscosity. The gel can plug permeable zones and flow pathways because it can withstand substantial amounts of pressure without being dislodged or extruded.

The superabsorber may have a particle size (i.e., diameter) of greater than or equal to about 0.01 mm, alternatively greater than or equal to about 0.25 mm, alternatively less than or equal to about 14 mm, before it absorbs water (i.e., in its solid form). The larger particle size of the superabsorber allows it to be placed in permeable zones in the wellbore, which are typically greater than about 1 mm in diameter. As the superabsorber undergoes hydration, its physical size may increase by about 10 to about 800 times its original weight. The resulting size of the superabsorber is thus of sufficient size to flow and at least partially block and/or to create at least a partial barrier of the aperture of the tool body 50. This may also be referred to as forming an at least partial barrier to flow through the aperture of the tool body 50. It is to be understood that the amount and rate by which the superabsorber increases in size may vary depending upon temperature, grain size, and the ionic strength of the carrier fluid. The temperature of a well typically increases from top to bottom such that the rate of swelling increases as the superabsorber passes downhole. The rate of swelling also increases as the particle size of the superabsorber decreases and as the ionic strength of the carrier fluid, as controlled by salts, such as sodium chloride or calcium chloride, decreases and vice versa.

The swell time of the superabsorber may be in a range of from about one minute to about thirty-six hours, alternatively in a range of from about three minutes to about twenty-four hours, alternatively in a range of from about four minutes to about sixteen hours, alternatively in a range of from about one hour to about six hours.

In an embodiment, the flowable material 54 may comprise one or more fluids that cure into a viscous material, a semisolid material, and/or a solid when exposed to water or to other substances. In an embodiment, the flowable material 54 may comprise two flowable materials separated by a bulkhead or retained within separate bladders that cure when mixed to become at least one of viscous, semisolid, and solid. One of the flowable materials may be a powder that flows in response to the detonation of the explosive charge 52 to mix with the second flowable material. In an embodiment, the flowable material 54 may comprise two flowable materials separated by a bulkhead or retained within separate bladders that cure when mixed to become at least one of viscous, semisolid, and solid that swells by absorbing material from the environment surrounding the perforation tool 32, for example by absorbing water and/or hydrocarbons. In an embodiment, the flowable material 54 may be an elastomeric material or some other compressible material that is installed into the countersunk hole 58 in a compressed state when constructing the perforation tool 32.

Figure 3A:
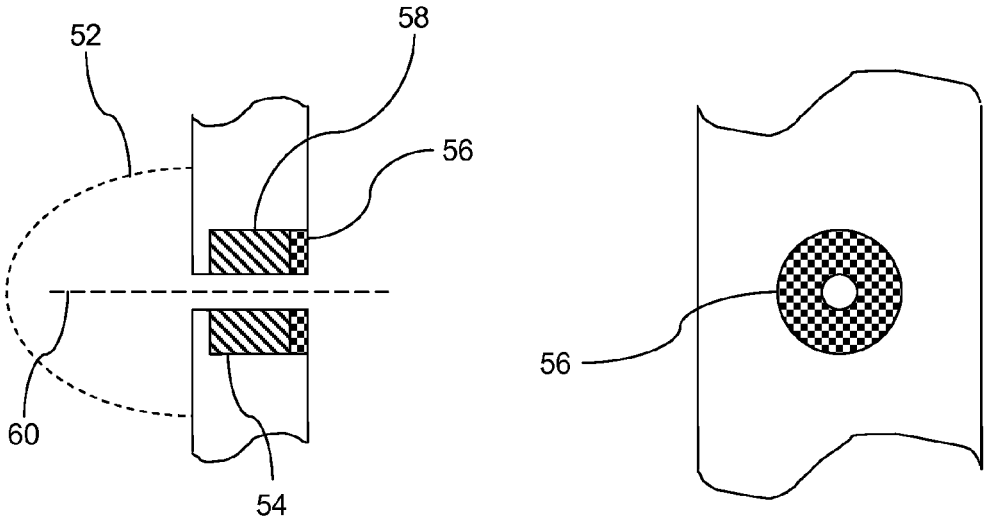
FIG. 3A illustrates the explosive charge, the portion of the perforation tool body, and the flowable material in a first state according to an embodiment of the disclosure.

Turning now to FIG. 3A, the flowable material 54 and the cap 56 are shown sometime after the explosive charge 52 has been detonated. While the explosive charge 52 is represented with dotted lines in FIG. 3A for purposes of orientation, it is understood that the explosive charge 52 and any associated liners would likely be propelled into the tunnels created in the formation 14, destroyed, and/or reduced to pieces of scrap metal during detonation of the explosive charge 52. The tool body 50, the flowable material 54, and the cap 56 have been perforated and/or pierced by the explosion of the explosive charge 52, leaving a hole open between an interior and an exterior of the perforation tool 32. The open hole provides an escape path for debris to escape from the interior to the exterior of the perforation tool 32 and to the wellbore 12, if the perforation tool 32 were to be removed from the wellbore 12 in the illustrated condition. The open hole further may provide a path for debris which was released into the wellbore 12 during the detonation to rebound back into the interior of the perforation tool 32, for example 100 microseconds after the detonation of the explosive charge 52, a millisecond after the detonation of the explosive charge 52, ten milliseconds after the detonation of the explosive charge 52, one hundred milliseconds after the detonation of the explosive charge, or some other period of time.

Figure 3B:
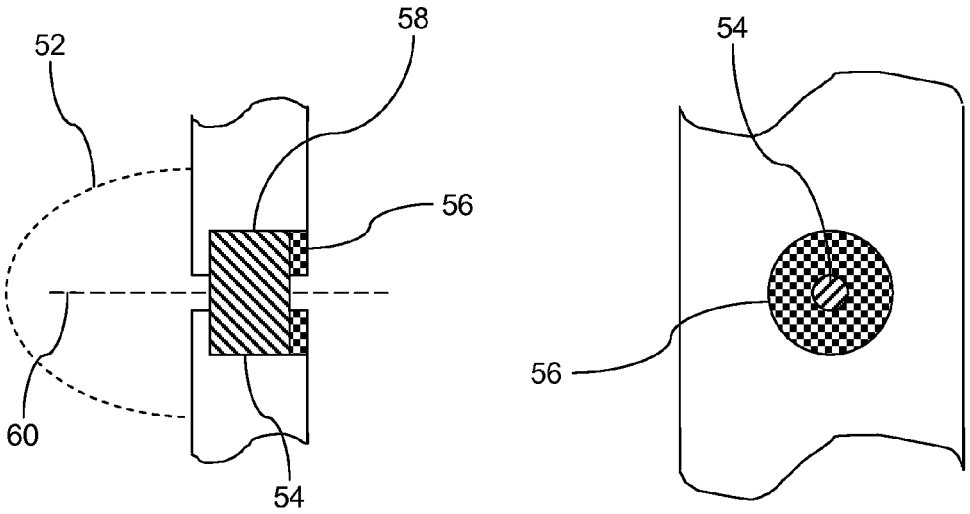
FIG. 3B illustrates the explosive charge, the portion of the perforation tool body, and the flowable material in a second state according to an embodiment of the disclosure.

Turning now to FIG. 3B, the flowable material 54 has flowed to substantially close the hole, thereby preventing debris escaping through the hole from the interior to the exterior of the perforation tool 32. It will be appreciated that even if the hole is not completely closed by the flow of the flowable material 54, partial closure and/or barrier of the hole as the flowable material 54 flows back into the space of the hole may reduce the amount of debris which escapes as the perforation tool is withdrawn from the wellbore 12. In an embodiment, some time may be consumed while the flowable material 54 closes the hole. For example, the flowable material 54 may flow and close the hole over about one minute, about three minutes, about four minutes, about sixty minutes, about six hours, about sixteen hours, about twenty-four hours, about thirty-six hours, or some other period of time. In an embodiment, the flowable material 54 may seal within the interior of the perforation tool 32 material released from the wellbore 12 and/or the wall of the wellbore 12 during perforation that entered interior of the perforation tool 32 through the open hole during the rebound after detonating the explosive charge 52. When the perforation tool 32 is withdrawn from the wellbore 12, the material released from the wellbore 12 and/or the wall of the wellbore 12 and sealed within the interior of the perforation tool 32 may be analyzed.

Figure 4:
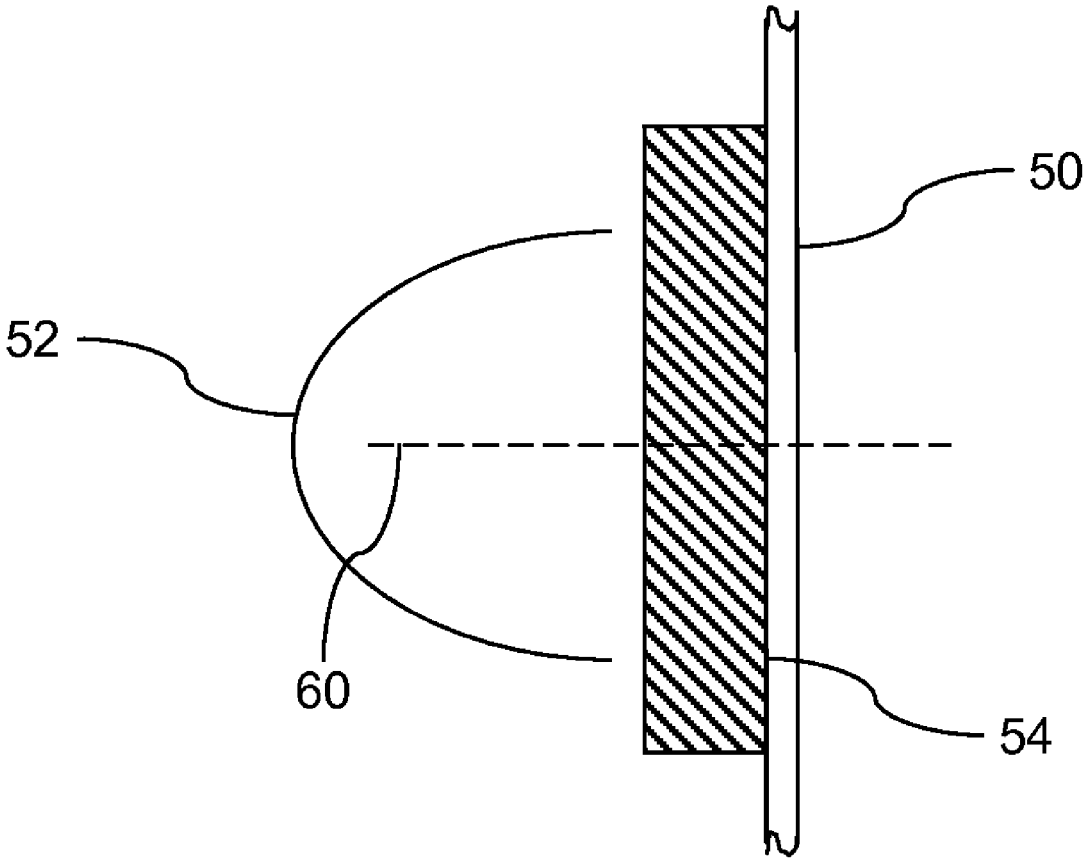
FIG. 4 illustrates an explosive charge, a portion of a perforation tool body, and a flowable material according to another embodiment of the disclosure.

Turning now to FIG. 4, another embodiment of the perforation tool 32 is described. The embodiment depicted in FIG. 4 is substantially similar to the embodiment described above with reference to FIG. 2, with the exception that the flowable material 54 is located between the explosive charge 52 and an inner wall of the tool body 50. Because the tool body 50 protects the flowable material 54 from contamination and/or cutting, there is no need for the cap 56 and no need for the countersunk hole 58. In an embodiment, the outside surface of the tool body 50 may be partially bored out or scooped out (not shown) in an area proximate to the explosive focus axis 60 to create a point of weakness. The point of weakness may facilitate the ease of the explosive charge 52 penetrating the tool body 50. In some contexts, such partially bored out or scooped out areas on the surface of the tool body 50 may be referred to as scallops.

In an alternative embodiment, the flowable material 54 may be located between the explosive charges 52, for example in an axially centered location between a plurality of explosive charges 52. When the explosive charge 52 and/or charges 52 detonate and penetrate the tool body 50, the flowable material 54 may flow to create at least a partial barrier of the aperture formed in the tool body 50 by the detonation of the explosive charge 52. This may also be referred to as forming an at least partial barrier to flow through the aperture and/or apertures. In an embodiment, the flowable material 54 may be contained in one or more bladders that may be penetrated by the detonation of the explosive charge 52 and thereafter flow to form an at least partial barrier of the apertures formed in the tool body 50 by detonation of the charge 52. For example, the bladder may contain a liquid that forms a viscous gel, a semisolid, or solid when mixed with water and/or hydrocarbons. For example, the bladders may contain two liquids that when mixed form a viscous gel, a semisolid, or solid when mixed together. In an embodiment, the flowable material 54 may be a swellable material that swells by absorbing material from the environment surrounding the tool body 50, for example fluids in the wellbore 12, such as water and/or hydrocarbons. When the explosive charge 52 detonates, penetrating the tool body 50, the fluids surrounding the tool body 50 flow through the aperture and/or apertures created in the tool body 50 by detonation of the charges, the swellable material absorbs some of the fluids and swells to form an at least partial barrier to egress of debris from the interior of the tool body 50 out of the aperture and/or apertures into the wellbore 12.

Figure 5A:
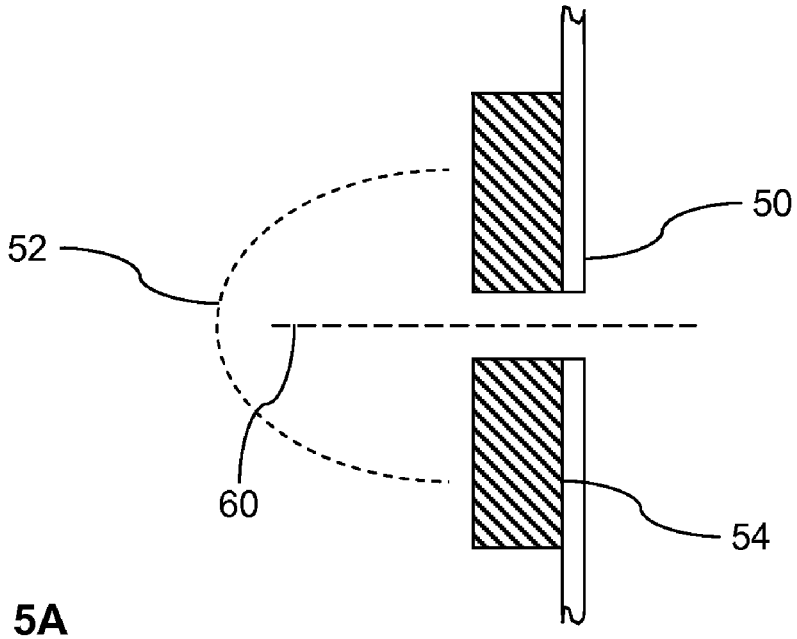
FIG. 5A illustrates the explosive charge, the portion of the perforation tool body, and the flowable material in a first state according to an embodiment of the disclosure.
Figure 5B:
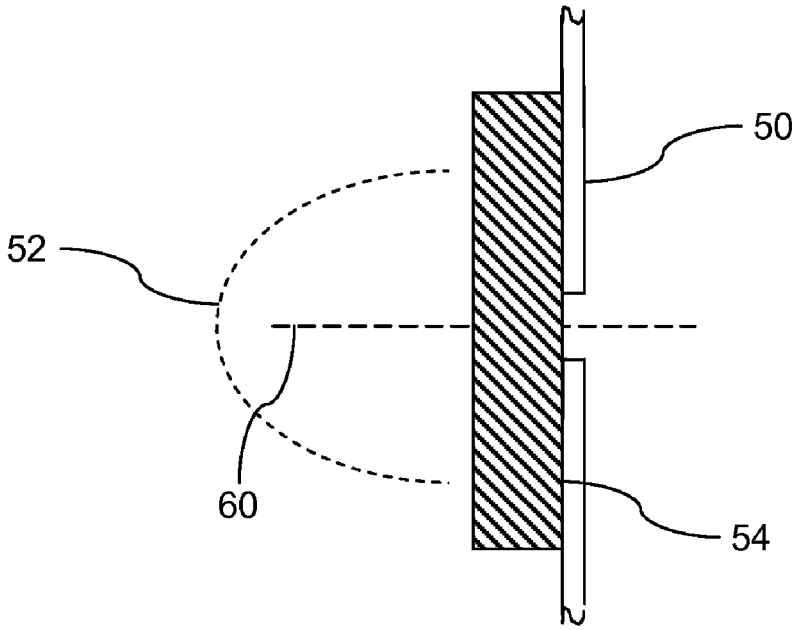
FIG. 5B illustrates the explosive charge, the portion of the perforation tool body, and the flowable material in a second state according to an embodiment of the disclosure.

Turning now to FIG. 5A, the flowable material 54 is shown sometime after the explosive charge 52 has been detonated. While the explosive charge 52 is represented with a dotted line in FIG. 5A for purposes of orientation, it is understood that the explosive charge 52 and any associated liners would likely be propelled into tunnels formed in the formation 14, destroyed, and/or reduced to pieces of scrap metal during detonation of the explosive charge 52. The flowable material 54 and the tool body 50 have been perforated and/or pierced by the explosion of the explosive charge 52, leaving a hole open between the interior and the exterior of the tool body 50. Turning now to FIG. 5B, the flowable material 54 has flowed to substantially close the hole. It will be appreciated that even if the hole is not completely closed by the flow of the flowable material 54, partial closure and/or formation of a partial barrier of the hole will reduce the amount of debris which escapes as the perforation tool is withdrawn from the wellbore 12. It may be an advantage that gaps are left to allow some fluid flow while blocking most solid particles, for example blocking fines and debris. In the event that it is desired for the perforation tool 32 to capture a sample of the environment, it may be that the significant material desired to be captured is mainly the solid particles, for example fines.

It may be an advantage of both the embodiment of FIG. 2 and of FIG. 4 that the activation of the flowable material 54 does not depend on mechanical mechanisms which may fail under the high stress of the detonation of the explosive charge 52 and/or explosive charges 52. In an embodiment, the detonation of the explosive charge 52 that perforates the tool body 50 is the action that allows an activation agent—for example water and/or hydrocarbons—to contact the flowable material 54 and cause it to flow and at least partially block the hole formed in the tool body 50 by the detonation of the explosive charge 52. In another embodiment, the detonation of the explosive charge 52 that perforates the tool body 50 is the action that releases the one or more flowable substances to flow to at least partially block the hole and/or to create at least a partial barrier to egress of debris through the hole formed in the tool body 50 by the detonation of the explosive charge 52, for example by curing and/or forming a semi-solid and/or solid material. Further, it may be an advantage of both the embodiment of FIG. 2 and of FIG. 4 that the flowable material 54 does not activate in the event of a misfire, for example when a detonation cord is fired but the explosive charge 52, for whatever reason, does not detonate.

An alternative disposition of the flowable material 54 is substantially similar to that described above with reference to FIG. 4, FIG. 5A, and FIG. 5B, except that the flowable material 54 is located on either side of the explosive charge 52 and not on the explosive focus axis 60. When the flowable material 54 comprises one or more flowable materials that flow and form a gel, semi-solid, or solid to create at least a partial barrier of the aperture in the tool body 50, the bladder and/or containers holding the material and/or materials may be ruptured by the detonation of the explosive charge 52, even though the flowable material 54 is not located on the explosive focus axis 60. Likewise, if the flowable material 54 is a swellable material that swells when contacted by water and/or hydrocarbons, the flowable material 54 may swell, hence swell, and at least partially create a barrier to flow through the aperture in the tool body 50, even though the flowable material 54 is not located on the explosive focus axis 60.

Figure 6:
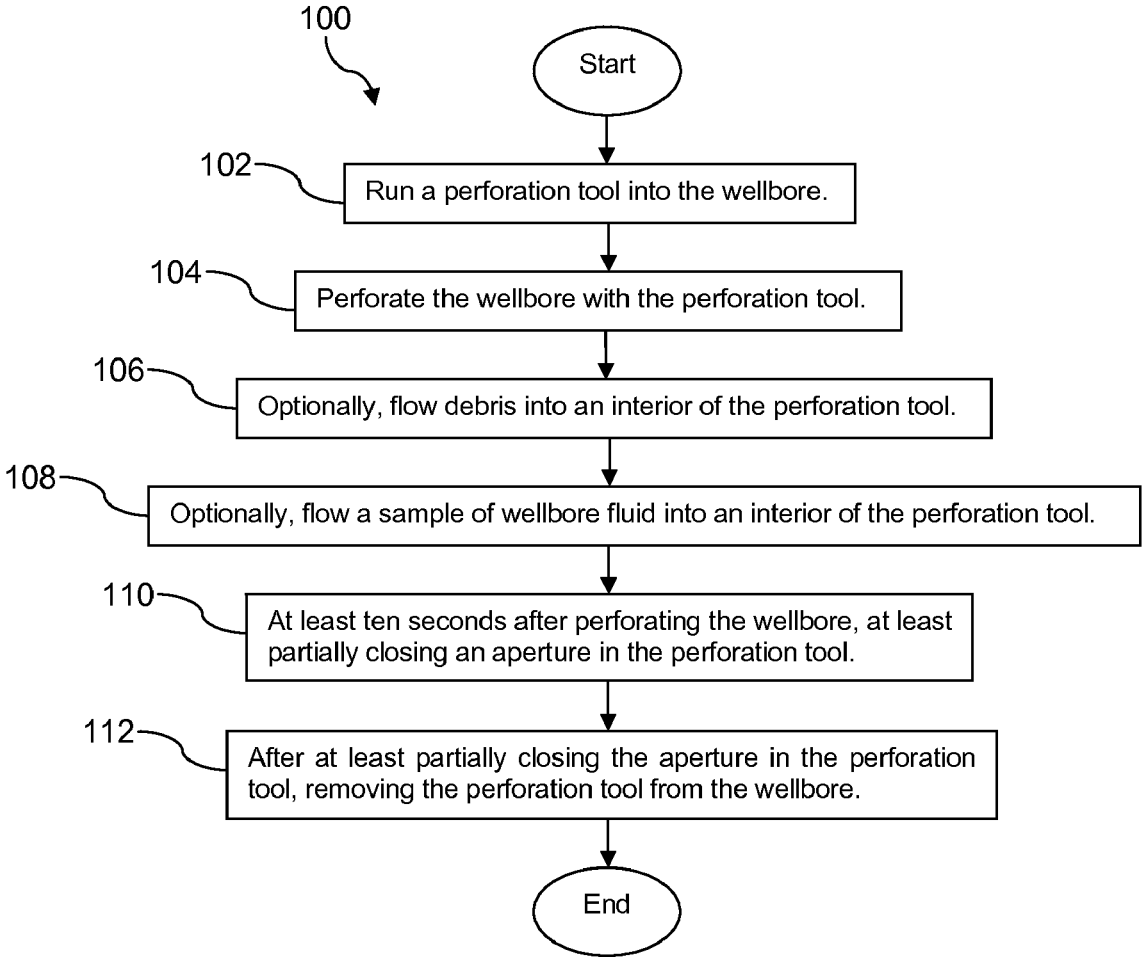
FIG. 6 is a flow chart of a method according to an embodiment of the disclosure.

Turning now to FIG. 6, a method 100 is discussed. At block 102, the perforation tool 32 is run into the wellbore 12. In an embodiment, running in the perforation tool 32 may comprise diverting the perforation tool 32 into a lateral wellbore drilled off of the wellbore 12. The lateral wellbore may be deviated and/or horizontal along at least a portion of its path. At block 104, the wellbore 12 and/or lateral wellbore is perforated using the perforation tool 32. Perforating the wellbore 12 and/or lateral wellbore may comprise detonating the explosive charge 52, creating a hole or aperture in the flowable material 54 and in the tool body 50. Alternatively, detonating the explosive charge 52 may not create a hole in the flowable material 54, for example when the flowable material 54 is located inside the tool body 50, away from the explosive focus axis 60. Immediately after the detonation of the explosive charge 52, a near vacuum may be created in the interior of the tool body 50 and debris may be expelled from the interior of the tool body 50 through the aperture in the tool body 50 and into the wellbore 12. After detonation, the pressure differential between the wellbore 12 and the interior of the tool body 50 will equalize and debris and wellbore fluid will flow from the wellbore 12 into the interior of the tool body 50. The material that flows into the interior of the tool body 50 may comprise material from the wall of the wellbore 12 and/or material from the formation that has been penetrated by the firing of the perforation tool 32, and this material may be considered to be a sample of wellbore fluid and/or formation material.

At block 106, debris is optionally flowed into the interior of the tool body 50 as described above. At block 108, a sample of wellbore fluid and/or fines suspended in the wellbore fluid are optionally flowed into the interior of the tool body 50 as described above. This action and/or benefit may be lost or attenuated with another perforation tool 32 that may close the aperture in the tool body 50 nearly instantaneously.

At block 110, the aperture and/or apertures in the tool body 50 are significantly closed only after at least 10 seconds after perforating the wellbore 12. In an embodiment, it is desirable that the aperture and/or apertures formed in the tool body 50 by detonation of the explosive charge 52 remain substantially open and that flow through the apertures remain substantially unimpeded, at least long enough for some of the debris expelled from the perforation tool 32 during detonation of the explosive charge 52 to be flowed back into the interior of the tool body 50 and/or for a sample of the wellbore fluid outside the perforation tool 32 to flow into the interior of the tool body 32, as described above in optional blocks 106 and 108. After the passage of this time that is effective for the in-flow of fluid with debris and/or wellbore fluid, the aperture and/or apertures may begin to be blocked.

For example, in an embodiment, the flowable material 54 flows to create at least a partial barrier and/or to block the aperture partially or completely after about one minute, after about three minutes, after about four minutes, after about one hour, after about six hours, after about sixteen hours, after about twenty-four hours, after about thirty-six hours, or after some intermediate period of time between the time extremes identified herein. This may also be referred to as forming an at least partial barrier to flow through the aperture. The flowable material 54 may be a swellable material that swells when exposed to wellbore fluids containing water and/or when exposed to hydrocarbons such as xylene and other hydrocarbons to create at least a partial barrier of and/or to partially or completely block the aperture in the tool body 50. For example, water and/or hydrocarbons may flow through the aperture in the tool body 50 to contact and activate the flowable material 54.

Alternatively, the flowable material 54 may be another material that flows into the aperture and turns into at least one of a viscous material, a semisolid material, or a solid material on exposure to wellbore fluids and/or hydrocarbons. Alternatively, the flowable material 54 may comprise two materials carried with the tool separated by bladders or by segregated compartments that are ruptured by the detonation of the explosive charge 52. After the detonation of the explosive charge 52, the two materials may flow into or proximate to the aperture in the tool body 50, mix, and cure to form a viscous material, a semisolid material, or a solid material to create at least a partial barrier of and/or to partially or completely block the aperture in the tool body 50. In an embodiment, one of the two materials may be a powder that flows in the transient conditions of the detonation of the explosive charge 52 to mix with the second material.

Depending upon the flowable material 54 carried with the perforation tool 32, different periods of time may pass to complete the action of significantly blocking the aperture in the tool body 50. Additionally, at the point that the flowable material 54 may be deemed to significantly block the aperture in the tool body 50, the flowable material 54 may continue to flow and increasingly block the aperture in the tool body 50 for a period of time. For example, in an embodiment, the flowable material 54 may be said to significantly block the aperture in the tool body 50 after 30 minutes and may be said to reach 95% of its maximum blocking potential after 12 hours. In other circumstances, however, different periods of time may pass to achieve a significant blocking of the aperture and to achieve 95% of maximum blocking potential.

Alternatively, the aperture and/or apertures may be at least partially closed by a mechanical apparatus that actuates after the expiration of a timer or actuated by some process which takes some time to progress to the point where the mechanical apparatus is actuated, a time effective for obtaining a sample of debris and/or a sample of wellbore fluid, as described above with reference to block 104 and block 106. For example, in an embodiment, swellable material contained within the tool body 50 may be actuated to swell by contact with the in-flow of wellbore fluids—either water and/or hydrocarbons—into the interior of the tool body 50; the swelling of the material may then trigger a latch retaining a spring-loaded mechanical shutter which then is displaced by the spring to at least partially close the aperture and/or apertures. Other like mechanical mechanisms that may be triggered in a delayed fashion and operable to at least partially close the aperture and/or apertures may likewise be employed. Actuating the mechanical apparatus may be referred to as deploying the mechanical apparatus.

After the desired period of time has passed to allow the flowable material 54 to partially or completely block the aperture in the tool body 50, at block 112 the perforation tool 32 is removed from the wellbore 12. Because the aperture in the tool body 50 is at least partially blocked, littering of debris from the interior of the tool body 50 to the exterior of the tool body 50 and into the wellbore 12 during withdrawl of the perforation tool 32 is reduced.

In an embodiment, a the perforation tool 32 may employ a swellable material as a prime mover to actuate a mechanical mechanism to close or at least partially close the aperture formed in the tool body 50. For example, the swellable material may be exposed to water and/or hydrocarbons as a result of firing the perforation tool 32, as the swellable material swells it applies force to a piston, and the piston drives a metal shutter into place to close the aperture formed in the tool body 50. Alternatively, the piston may actuate a diaphragm shutter to close the aperture.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of perforating a wellbore, comprising:

running a perforation tool into the wellbore, wherein the perforation tool comprises a tool body, a flowable material carried with the perforation tool, and wherein the tool body defines a countersunk hole on an exterior of the tool body in which the flowable material is retained, and a cap that retains the flowable material in the countersunk hole;

the perforation tool perforating the wellbore; and substantially closing an aperture in the perforation tool only after at least 10 seconds after perforating the wellbore.

2. The method of claim 1, wherein, after the perforation tool perforates the wellbore, the flowable material carried with the perforation tool flows to at least partially close the aperture in the perforation tool.

3. The method of claim 2, wherein the flowable material swells when exposed to at least one of water and hydrocarbons.

4. The method of claim 2, wherein the flowable material cures in the presence of water to become at least one of viscous, semisolid, and solid.

5. The method of claim 2, wherein the flowable material comprises at least two liquids that cure when mixed to become at least one of viscous, semisolid, and solid.

6. The method of claim 2, wherein the flowable material comprises an acid-base cement that cures in the presence of water to become at least one of semisolid and solid.

7. The method of claim 1, further comprising flowing some debris into an interior of the perforation tool after perforating the wellbore and before substantially closing the aperture in the perforation tool.

8. The method of claim 1, further comprising, after substantially closing the aperture in the perforation tool, removing the perforation tool from the wellbore.

9. The method of claim 8, further comprising flowing some of wellbore fluid into an interior of the perforation tool after perforating the wellbore and before substantially closing the aperture in the perforation tool, wherein removing the perforation tool from the wellbore comprises bringing the sample of wellbore fluid to the surface.

10. The method of claim 1, wherein substantially closing the aperture in the perforation tool only after at least 10 seconds further comprises deploying a mechanical shutter.

11. A perforation tool, comprising:

an explosive charge;

a tool body containing the explosive charge, wherein the explosive charge is a shaped explosive charge; and a swellable material carried with the tool body, wherein the swellable material is carried in a countersunk hole in the tool body, and wherein the countersunk hole in the tool body is positioned on an explosive focus axis of the shaped explosive charge; and a cap that retains the flowable material in the countersunk hole.

12. The tool of claim 11, wherein the swellable material comprises at least one of a cross-linked polyacrylamide material, an ethylene propylene diene rubber (EPDM) compound material, and a low acrylic-nitrile material.

* * * * *